US010568435B2

(12) United States Patent
Luckemeyer et al.

(10) Patent No.: US 10,568,435 B2
(45) Date of Patent: Feb. 25, 2020

(54) MULTI-LAYERED PATIENT SUPPORT COVER SYSTEM

(71) Applicants: HUNTLEIGH TECHNOLOGY LIMITED, Dunstable (GB); James A. Luckemeyer, San Antonio, TX (US); Christopher Locke, Bournemouth (GB)

(72) Inventors: James A. Luckemeyer, San Antonio, TX (US); Christopher Locke, Bournemouth (GB)

(73) Assignee: Huntleigh Technology Limited (GB)

( * ) Notice: Subject to any disclaimer, the term of this patent is extended or adjusted under 35 U.S.C. 154(b) by 0 days.

(21) Appl. No.: 14/424,785

(22) PCT Filed: Aug. 30, 2013

(86) PCT No.: PCT/US2013/057627
§ 371 (c)(1),
(2) Date: Feb. 27, 2015

(87) PCT Pub. No.: WO2014/036466
PCT Pub. Date: Mar. 6, 2014

(65) Prior Publication Data

US 2015/0216315 A1 Aug. 6, 2015

Related U.S. Application Data

(60) Provisional application No. 61/695,002, filed on Aug. 30, 2012.

(51) Int. Cl.

| | |
|---|---|
| ***A47C 21/04*** | (2006.01) |
| ***A61G 7/057*** | (2006.01) |
| ***A47G 9/02*** | (2006.01) |

(52) U.S. Cl.
CPC ..... *A47C 21/044* (2013.01); *A47G 9/0238* (2013.01); *A61G 7/057* (2013.01); *A61G 2203/30* (2013.01)

(58) Field of Classification Search
CPC ..... A47C 21/04
USPC ..... 5/710, 713–714, 726, 423, 652.1–652.2
See application file for complete search history.

(56) References Cited

U.S. PATENT DOCUMENTS 5,249,320 A * 10/1993 Moretz ..... A61F 5/01 5/484
5,926,884 A * 7/1999 Biggie ..... A61G 7/05776 297/180.13
5,963,997 A * 10/1999 Hagopian ..... A61G 7/05776 5/654

(Continued)

FOREIGN PATENT DOCUMENTS

CN 101069601 A 11/2007
CN 101442924 A 5/2009

(Continued)

OTHER PUBLICATIONS

International Search Report for International application No. PCT/US2013/057627, dated Jan. 9, 2014, 2 pages.

(Continued)

*Primary Examiner* — Fredrick C Conley
(74) *Attorney, Agent, or Firm* — The Webb Law Firm

(57) ABSTRACT

In various embodiments, a support system includes a cover sheet with a number of layers. In certain embodiments, a top layer and a bottom layer are bonded to a middle spacer layer.

21 Claims, 3 Drawing Sheets

(56) References Cited

U.S. PATENT DOCUMENTS

| | | | | |
|---|---|---|---|---|
| 2005/0229317 | A1* | 10/2005 | Heiser | A47C 7/742 5/653 |
| 2007/0261548 | A1* | 11/2007 | Vrzalik | A47C 21/044 95/52 |
| 2009/0056030 | A1* | 3/2009 | Bolden | A47C 27/006 5/713 |
| 2010/0274331 | A1 | 10/2010 | Williamson et al. | |
| 2011/0107514 | A1* | 5/2011 | Brykalski | A47C 21/044 5/421 |
| 2011/0289684 | A1 | 12/2011 | Parish et al. | |

FOREIGN PATENT DOCUMENTS

| | | | |
|---|---|---|---|
| CN | 201996040 | U | 10/2011 |
| DE | 10 2005 004971 | A1 | 9/2006 |
| DE | 10 2007 014152 | A1 | 9/2008 |
| JP | 3202016 | A | 9/1991 |
| JP | 6253966 | A | 9/1994 |
| JP | 2000274 | A | 1/2000 |
| JP | 2009536860 | A | 10/2009 |
| WO | 2007134246 | A2 | 11/2007 |

OTHER PUBLICATIONS

Merriam-Webster's Collegiate Dictionary—10th ed., 1993, 1352, Merriam-Webster, Inc., U.S.

* cited by examiner

MULTI-LAYERED PATIENT SUPPORT COVER SYSTEM

CROSS-REFERENCE TO RELATED APPLICATIONS

This application is a nationalization of International Patent Application No. PCT/US2013/057627, filed on Aug. 30, 2013, pursuant to 35 USC § 371, which in turn claims the benefit of priority to U.S. Provisional Patent Application Ser. No. 61/695,002, filed Aug. 30, 2012, the entire contents thereof are incorporated by reference herein.

FIELD OF THE INVENTION

The present disclosure relates generally to support surfaces for independent use and for use in association with beds and other support platforms, and more particularly but not by way of limitation to support surfaces that aid in the prevention, reduction, and/or treatment of decubitus ulcers and the transfer of moisture and/or heat from the body.

BACKGROUND

Patients and other persons restricted to bed for extended periods incur the risk of forming decubitus ulcers. Decubitus ulcers (commonly known as bed sores, pressure sores, pressure ulcers, etc.) can be formed when blood supplying the capillaries below the skin tissue is interrupted due to external pressure against the skin. This pressure can be greater than the internal blood pressure within a capillary, and thus occlude the capillary and prevent oxygen and nutrients from reaching the area of the skin in which the pressure is exerted. Moreover, moisture and heat on and around the person can exacerbate ulcers by causing skin maceration, among other associated problems.

We wish to be able to manage larger quantities of body fluids including sweat, urine, wound fluids, etc., by improving the moisture management efficiency of a patient support cover sheet system such as Skin IQ™ product (which incorporates an electrically-powered fan to move air within an open layer beneath the patient) manufactured by Kinetic Concepts Inc. of San Antonio, Tex.

In a hospital environment, if a patient urinates on a cover, this has to be firstly detected by the caregiver, and the mattress cover changed. User experience with the Skin IQ™ patient support cover sheet indicates that an occasional urine leak can and will be managed via evaporation through the Skin IQ™ cover; however, if a significant quantity of fluid is involved, the patient is exposed to moisture for an extended duration during which there is increased risk of skin breakdown, where the duration of the moisture exposure depends upon the evaporation rate through the cover sheet system. By improving the fluid management efficiency of the cover sheet system, we not only reduce this skin breakdown risk and make it a product attribute, but we can also render the system more electrically efficient by maximizing the surface area which is exposed to airflow and moisture dissipation.

SUMMARY

Exemplary embodiments of the present disclosure are directed to apparatus, systems and methods to aid in the prevention of decubitus ulcer formation and/or promote the healing of such ulcer formation by managing patient skin exposure to moisture at the support surface cover sheet interface.

In various embodiments, a patient support system includes a cover sheet with a number of layers. In certain embodiments, the layers have different hydrophobic or hydrophilic properties and establish a fluid gradient to preferentially move fluid away from areas that contact a patient. Exemplary embodiments can also improve the net efficiency of the system by ensuring that the fluids are maximally exposed to the airstreams within the structure, and reduce the likelihood of fluid being held in dense local regions. In addition, exemplary embodiments overcome the challenge of having the majority of fluid pool in the area where there is the most compression of the structure (e.g., underneath the patient at contact pressure points). Exemplary embodiments also provide the ability to evaporate a bolus of fluid over a longer period of time, which can reduce air flow requirements and electrical power consumption by the patient support cover sheet system.

Exemplary embodiments can also provide a safety mechanism in that event that if air flow is interrupted for a period of time, e.g., if power is temporarily unavailable due to a power failure or the patient being moved to an area where power is not available. By moving the fluid away from the patient contact areas, the system can reduce the likelihood that the patient's skin will suffer negative effects such as decubitus ulcers, even without the benefit of air flow through the cover sheet system. By considering the hydrophobic/hydrophilic nature of each material in the structure and ensuring that there is in all cases a hydrophilic gradient away from the patient, the system can be configured such that moisture does not remain on the skin contacting layers.

In existing systems with multiple layers having similar hydrophobicity levels, the fluid will not flow from one into the other layer unless under the influence of an external stimulus. One objective of the disclosed system is to move the fluid into a place where it is maximally exposed to airflow such that the evaporation layer is able to release water molecules from the boundary layer of a material. As such, this becomes one end of the moisture gradient and any internal layers should not be more hydrophilic than the boundary layer effects of the system; otherwise, they will saturate with fluids and stall the transfer of moisture.

Exemplary embodiments have therefore established the two extremes required for the system: a first, very hydrophobic layer which is disposed to be in contact with the patient such that all fluids are encouraged to move under osmotic pressure into the device structure away from the patient skin; and further that any materials in the structure may not have an osmotic pressure which exceeds that of boundary layer effects noted in the previous paragraph.

In various exemplary embodiments, systems are provided that can include a number of components that both aid in prevention of decubitus ulcer formation and to remove moisture and/or heat from the patient. For example, systems can include a multi-layer cover sheet that can be used in conjunction with a variety of support surfaces, such as an inflatable mattress, a foam mattress, a gel mattress, a water mattress, or a RIK® Fluid Mattress of a hospital bed. In such exemplary embodiments, features of the multi-layer cover sheet can help to remove moisture from the patient and to lower interface pressures between a patient and the surface of the multi-layer cover sheet, while features of the inflatable or foam mattress can aid in the prevention and/or healing of decubitus ulcers by further lowering interface pressures at areas of the skin in which external pressures are typically high, as for example, at bony prominences such as the heel and the hip area of the patient. In other exemplary embodiments, systems can include the multi-layer cover sheet used in conjunction with a chair or other support platform.

BRIEF DESCRIPTION OF THE DRAWINGS

While exemplary embodiments of the present invention have been shown and described in detail below, it will be clear to the person skilled in the art that changes and modifications may be made without departing from the scope of the invention. As such, that which is set forth in the following description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, portions of the support system shown and described may be incorporated with existing mattresses or support materials. Other embodiments may utilize the support system in seating applications, including but not limited to, wheelchairs, chairs, recliners, benches, etc.

In the following Detailed Description of Disclosed Embodiments, various features are grouped together in several embodiments for the purpose of streamlining the disclosure. This method of disclosure is not to be interpreted as reflecting an intention that exemplary embodiments of the invention require more features than are expressly recited in each claim. Rather, as the following claims reflect, inventive subject matter lies in less than all features of a single disclosed embodiment. Thus, the following claims are hereby incorporated into the Detailed Description of Disclosed Embodiments, with each claim standing on its own as a separate embodiment.

Figure 1:
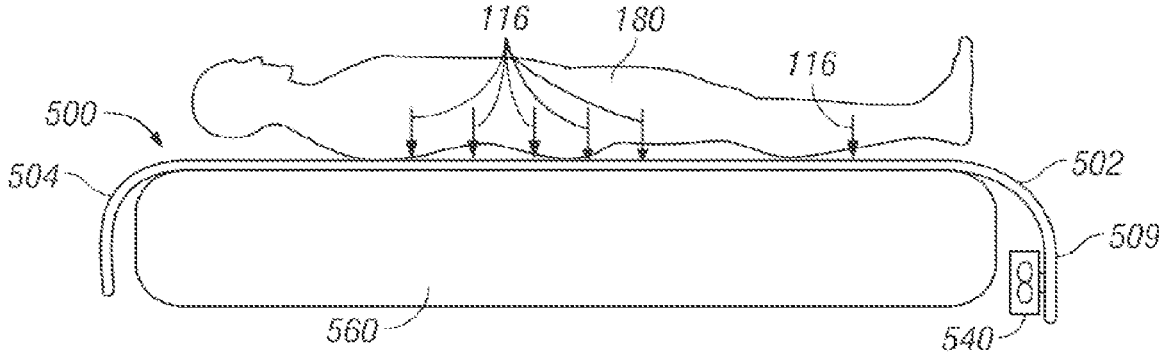

FIG. 1 illustrates a side view of a first exemplary embodiment of a cover sheet and a support mattress supporting a person.

Figure 2:
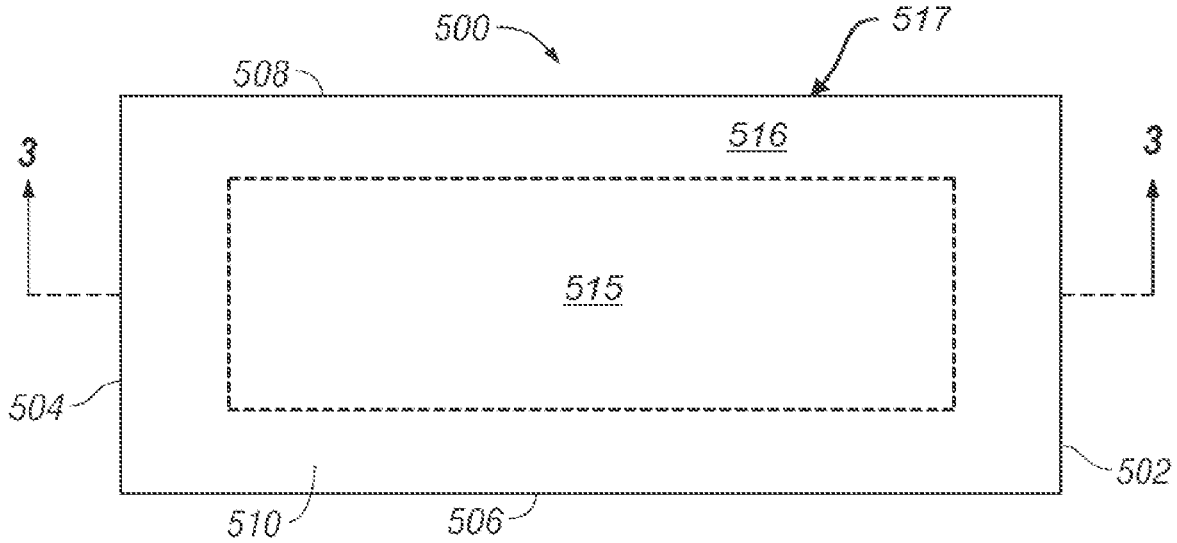

FIG. 2 illustrates a top view of an exemplary embodiment of the cover sheet of FIG. 1.

Figure 3:
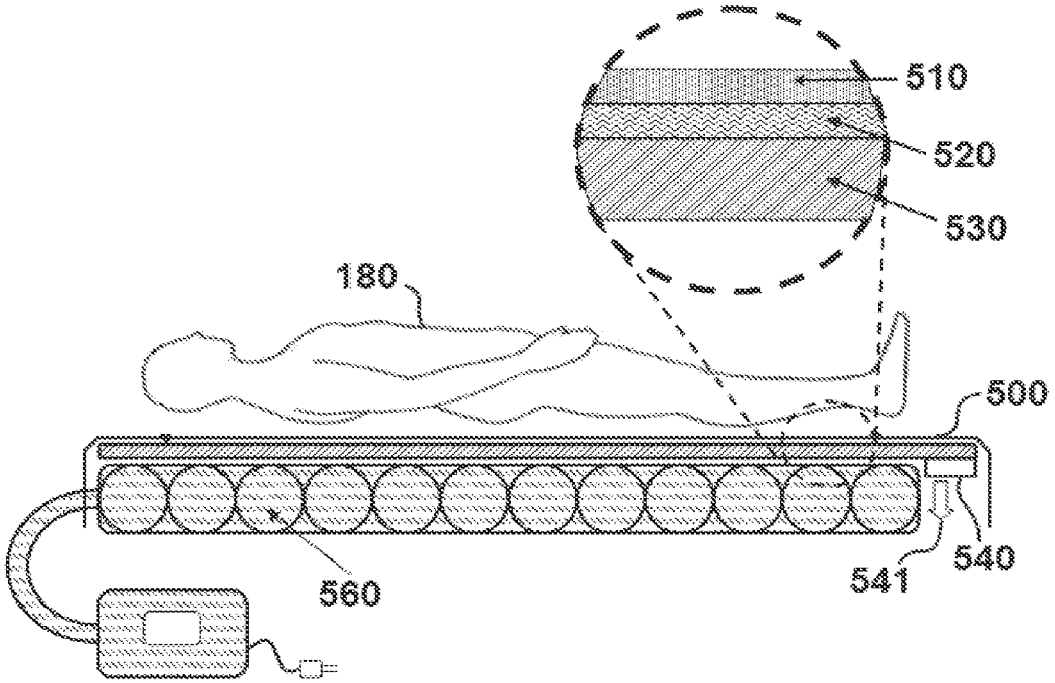

FIG. 3 illustrates a cross-sectional side view of the cover sheet of FIG. 1.

Figure 4:
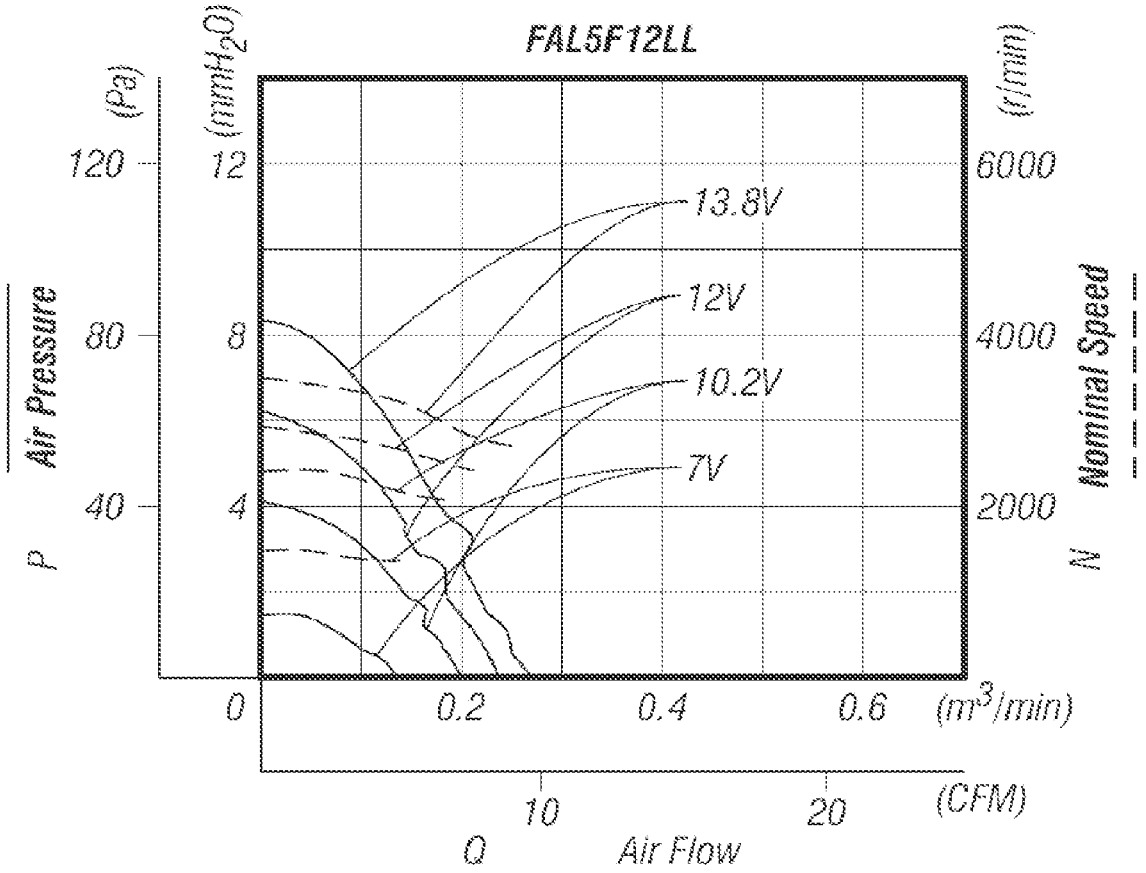

FIG. 4 illustrates a graph of air pressure versus flow for an embodiment of an air mover in one exemplary embodiment.

DETAILED DESCRIPTION OF DISCLOSED EMBODIMENTS

Exemplary embodiments of the present disclosure are directed to apparatus, systems and methods to aid in the prevention of decubitus ulcer formation and/or promote the healing of such ulcer formation. For example, in various embodiments, preventing ulcer formation and/or healing decubitus ulcers can be accomplished through the use of a multi-layer cover sheet. Exemplary embodiments of the multi-layer cover sheet can be utilized to aid in the removal of liquid, moisture vapor, and heat adjacent and proximal to the patient surface interface and in the environment surrounding the patient by providing a surface that absorbs and/or disperses the liquid moisture, moisture vapor, and heat from the patient. In addition, the exemplary embodiments of the multi-layer cover sheet can be utilized in combination with a number of support surfaces or platforms to provide a reduced interface pressure between the patient and the cover sheet on which the patient is positioned. This reduced interface pressure can also help to prevent the formation of decubitus ulcers.

In various exemplary embodiments, the cover sheet may include a number of layers. Each layer may be formed of a number of different materials that exhibit various properties. These properties may include the hydrophobicity level, the level of friction or shear of a surface, the permeability of a vapor, a gas, a liquid, and/or a solid, and various phases of the vapor, the gas, the liquid, and the solid, and other properties.

Exemplary embodiments can also improve the fluid management capability of the system through careful selection of materials, and by establishing a fluid gradient across the structure such that fluids are moved away from the patient to an area where they may be efficaciously evaporated.

Exemplary embodiments disclosed herein are tailored to have a hydrophobicity/hydophilicity gradient which is directed to ensure that fluids are preferentially inclined to move away from the skin/contact area whether under the influence of flows or fluid, or air.

Referring now to FIGS. 1-3, an exemplary embodiment of a cover sheet 500 is disclosed. FIG. 1 illustrates a side view of cover sheet 500 during use and located between a patient 180 and a supporting mattress 560. FIG. 2 provides a top view of exemplary embodiments of cover sheet 500 (without patient 180 for purposes of clarity), while FIG. 3 provides a section view of cover sheet 500 taken along line 3-3 in FIG. 2.

The exemplary embodiments shown comprise an air permeable, water vapor-permeable first layer 510, a second layer 520, and a third layer 530 comprising a spacer material. It is understood that any of the individual layers may comprise a composite or laminate of multiple materials. As shown in FIG. 2, in this exemplary embodiment cover sheet 500 comprises a perimeter 517 with a first end 502, second end 504, first side 506 and second side 508. Exemplary embodiments of cover sheet 500 also comprise a central region 515 surrounded by a perimeter region 516, as shown in FIG. 2. It is understood that the rectangular shape of perimeter 517 shown in FIG. 2 is merely one example of numerous configurations that are possible. Other perimeter shapes, including for example, oval, square, or other polygonal shapes are possible and included within the scope of this description.

In this embodiment, central region 515 generally comprises an area in the central portion of cover sheet 500 as viewed from above, and includes an area that will be in contact with and beneath a patient laying on cover sheet 500 during normal use. Perimeter region 516 extends around central region 515 and within perimeter 517, and includes an area that will typically not be in contact with a patient laying on cover sheet 500 during normal use.

The general principles of operation for this exemplary embodiment are provided initially, followed by a more detailed description of individual components and principles of operation. In general, fluid 116 is transferred from a patient 180, through first layer 510 and into second layer 520, which distributes fluid 116 toward perimeter 517 before fluid 116 passes into third layer 530. Fluid 116 may comprise perspiration (including both liquid and moisture vapor) during typical use. In addition, fluid 116 may comprise other fluids, such as urine, from patient 180. As described in more detail below, during use air mover 540 pushes or pulls air through third layer 530 to facilitate the evaporation of fluid 116. The movement of air within the cover system by air mover 540, as well as the evaporation of fluid 116, also transfers heat away from patient 180.

In specific exemplary embodiments, first layer 510 is comprised of a highly hydrophobic material, while second layer 520 is comprised of a material that is more hydrophilic than first layer 510, and third layer 530 is comprised of a material that is more hydrophilic than second layer 520. Such a configuration can provide a fluid distribution gradient that promotes the movement of liquid away from first layer 510 and patient 180 during use.

In particular exemplary embodiments second layer 520 comprises fluid directional wicking properties such that when fluid 116 enters second layer 520, it is wicked laterally toward perimeter 517 and away from the interface of patient 180 and first layer 510. Such fluid movement can increase the exposure area of fluid 116 to both ambient airflows on first layer 510 and third layer 530. In addition, the movement of fluid 116 toward perimeter 517 can move fluid away from central region 515 and into perimeter region 516, which can reduce the fluid contact with patient 180. This can in turn decrease the likelihood that patient 180 will develop complications such as decubitus ulcers associated with prolonged fluid exposure at the interface between patient 180 and cover sheet 500.

In specific exemplary embodiments, second layer 520 may comprise a material such as Libeltex® TDL2, manufactured by Libeltex Group. This material has a two sided construction such that it will acquire fluids when one surface is exposed and, as the fluids permeate the material, the second side will use capillary action to wick or transport the fluids in a given direction.

In particular exemplary embodiments, third layer 530 comprises a spacer material of highly hydrophilic open-celled foam structure which serves as a manifold for fluid 116 from second layer 520 above into the foam structure, through which air is pushed or drawn for the purpose of evaporation. In certain exemplary embodiments, third layer 530 may comprise a spacer material of sintered polymers which do not collapse under the weight of patient 180 and also allow air flow through the material. Providing increased exposure of the hydrophilic area exposed to fluid 116 can improve the evaporation efficiency of cover sheet 500. In specific exemplary embodiments, the thickness of second and third layers 520 and 530 can be approximately 0.125 to 0.025 inches. In other exemplary embodiments, second and third layers 520 and 530 may be either thicker or thinner than this range.

In certain exemplary embodiments, the cover sheet may comprise layers in addition to those described above. For example, a breathable absorption layer (e.g., a non-woven fiber such as a Libeltex Aerofill or a thin non-woven material deposited with an absorber) could be included between second layer 520 and third layer 530. Such a layer could remain open to cover system air flows during low-moisture operation, and also to act as a reservoir in the instance that a larger volume of fluid were delivered than the evaporation process within the third layer 530 could manage. Such an embodiment could lead to the fluid being slowed on its progression through the structure, but would nonetheless keep the fluid away from patient 180. In addition, certain exemplary embodiments may comprise a fourth layer (not shown) between third layer 530 and supporting mattress 560.

First, second and third layers 510, 520 and 530 are capable of being fixed together during manufacture through a variety of methods known to one skilled in the art, such as with adhesives, welding, quilting etc. The laminated structure is readily amenable to volume manufacturing methods, and the materials and processes are currently used in the medical industry and for furnishings in compliance with global safety standards.

In certain embodiments, various sensors could be integrated into or between one or more of first, second or third layers 510, 520, or 530. In particular embodiments, the sensors can detect the presence of fluid, and the location of the sensors can be chosen to improve sensor performance and fan control system response.

In certain exemplary embodiments, air mover 540 can be a centrifugal 12 volt (nominal) DC fan manufactured by Panasonic under the part number FAL5F12LL. This particular air mover is approximately 3 inches wide by 3 inches tall by 1.1 inches thick and weighs approximately 3.5 ounces. This air mover also produces a maximum air flow of approximately 8.8 cfm and maximum air pressure of approximately 6.2 mm $H_2O$ at a nominal 12 volts. During operation, the air flow will be reduced as the pressure across the air mover is increased. Exemplary embodiments using this air mover typically have an air flow of approximately 1.0 to 2.0 cubic feet per minute (cfm) during operation. A graph of air pressure, air flow, and nominal speed for various voltages is provided in FIG. 4. As shown in FIG. 4, this air mover provides less than 6 mm $H_2O$ differential pressure at flow rates of approximately 2.0 cfm. The Panasonic FAL5F12LL air mover also creates low noise levels (30.0 dB-A, according to the manufacturer's specifications).

In another exemplary embodiment, air mover 540 is a 12 volt DC, 40 mm box fan such as a Sunon KDE 1204 PKBX-8. By utilizing an air mover such as the Sunon model (or other similarly-sized devices), air mover 540 can be placed integral to cover sheet 500, allowing for a more compact overall design.

In one exemplary embodiment, first layer 510 may be comprised of a material that is liquid impermeable and air impermeable, but is moisture vapor permeable. One example of such vapor permeable material is sold under the trade name GoreTex.™ GoreTex™ is vapor permeable and liquid impermeable, but may be air permeable or air impermeable.

As used in this disclosure, the term "spacer material" (and related terms) should be construed broadly to include any material that includes a volume of air within the material and allows air to move through the material. In exemplary embodiments, spacer materials allow air to flow through the material when a person is laying on the material while the material is supported by a mattress. Examples of such spacer materials include open cell foam, polymer particles, and a material sold by Tytex under the trade name AirX™ Additional examples and features of spacer materials are disclosed in the description of third layer 530 in FIG. 3.

Referring back to FIG. 1, supporting mattress 560 and cover sheet 500 system provide support for person 180 and aids in the removal of moisture, vapor and heat adjacent and proximal the interface between person 180 and support system 100. In the exemplary embodiment of FIG. 1, cover sheet 500 comprises an integral air mover 540. In other exemplary embodiments, air mover 540 may be external to cover sheet 500 with appropriate coupling members such as tubing, piping or duct work, etc. In certain exemplary embodiments, air mover 540 may comprise a guard or other partition (not shown) to prevent material from cover sheet 500 or the surrounding environment from blocking the inlet or outlet of air mover 540. During operation, air mover 540 shown in FIG. 1 operates to increase pressure within cover sheet 500 and create an air flow 541 that is pushed or forced through second layer 520 and into the surrounding environment.

In the exemplary embodiments shown in FIGS. 1-3, fluid 116 is transferred from person 180 (and the air adjacent person 180) through first layer 510 and second layer 520 to air pockets within the spacer material of third layer 530. Fluid 116 will continue to transfer to air pockets within spacer material while the air pockets are at a lower relative humidity than the air adjacent person 180. As the relative humidity of the air pockets increases and approaches the relative humidity of the air adjacent person 180, the transfer rate of fluid 116 will decrease. It is therefore desirable to maintain a lower relative humidity of the air pockets within third layer 530 than the relative humidity of the air adjacent person 180. As fluid 116 is transferred to air pockets within third layer 530, it is desirable to remove moisture vapor from the air pockets and lower the relative humidity of the air within third layer 530. By removing fluid 116 from the air within third layer 530, the transfer rate of fluid 116 from person 180 can be maintained at a more uniform level.

In the exemplary embodiment shown in FIG. 3, air flow 541 flows through the air pockets within third layer 530 and assists in removing fluid 116 from the air pockets. This lowers the relative humidity of the air pockets and allows the transfer rate of fluid 116 to be maintained over time. As shown in FIG. 3, air flow 541 from air mover 540 can be drawn (or forced) through the air space within third layer 530. By distributing fluid 116 into a larger area toward perimeter 517 prior to entering third layer 530, the amount of air flow 541 required for an effective moisture vapor transfer rate can be reduced as compared to systems that allow fluid 116 to enter third layer 530 in an area directly under person 180.

The reduction in the amount of air flow 541 for a given transfer rate of fluid 116 can also reduce the size required for the air mover 540. A decrease in the required air flow 541 can also reduce the amount of energy required to operate air mover 540, thereby reducing operating costs. Reduced energy requirements and air flow 541 from air mover 540 can also reduce the amount of noise and heat generated by air mover 540. A reduction in noise and heat can provide a more comfortable environment for person 180, who may use cover sheet 500 for extended periods of time.

A reduction in the size of air mover 540 may also lead to a reduction in the cost of air mover 540. In certain embodiments, the cost of air mover 540 may be low enough for air mover 540 to be a disposable item.

Support mattress 560 can be any configuration known in the art for supporting person 180. For example, in certain exemplary embodiments, support mattress 560 may be an alternating-pressure-pad-type mattress or other type of mattress utilizing air to inflate or pressurize a cell or chamber within the mattress. In other exemplary embodiments, support mattress 160 does not utilize air to support person 180.

The cover system can be placed on the person 180 to move fluid away from the skin, including above the person and without the inclusion of a support surface 160. It is not necessary for the cover system to remain flat as suggested by FIGS. 1 and 3, although performance may be compromised by folds or creases that reduce air flow 541.

As one of ordinary skill in the art will appreciate, vapor and air can carry organisms such as bacteria, viruses, and other potentially harmful pathogens. As such, and as will be described in more detail herein, in some embodiments of the present disclosure, one or more antimicrobial devices, agents, etc., can be provided to prevent, destroy, mitigate, repel, trap, and/or contain potentially harmful pathogenic organisms including microbial organisms such as bacteria, viruses, mold, mildew, dust mites, fungi, microbial spores, bioslimes, protozoa, protozoan cysts, and the like, and thus, remove them from air and from vapor that is dispersed and removed from the patient and from the environment surrounding the patient. In addition, in various embodiments, the cover sheet 500 can include various layers having antimicrobial activity. In some embodiments, for example, first, second and third layers, 510, 520 and 530 can include particles, fibers, threads, etc., formed of silver and/or other antimicrobial agents. Antimicrobial agents can also be introduced into the air stream 941, although distribution within the cover system would not be uniform.

In various exemplary embodiments, third layer 530 can be formed of various materials, and can have a number of configurations and shapes, as described herein. In some embodiments, the material is flexible. In such exemplary embodiments, the flexible material can include properties that resist compression, such that when the flexible material is compressed, for example, by the weight of a patient lying on cover sheet 500, the flexible material has a tendency to return toward its original shape, and thereby impart a supportive function to cover sheet 500. The flexible material can also include a property that allows for lateral movement of air through the flexible material even under compression.

Examples of materials that can be used to form third layer 530 can include, but are not limited to, natural and synthetic polymers in the form of particles, filaments, strands, foam (e.g., open cell foam), among others, and natural and synthetic materials such as cotton fibers, polyester fibers, and the like. Other materials can include flexible metals and metal alloys, shape memory metals and metal alloys, and shape memory plastics. These materials can include elastic, super elastic, linear elastic, and/or shape memory properties that allow the flexible material to flex and bend and to form varying shapes under varying conditions (e.g., compression, strain, temperature, ph, moisture, etc.).

In various exemplary embodiments, cover sheet 500 can be a one-time use cover sheet or a multi-use cover sheet. As used herein, a one-time use cover sheet is a cover sheet for single-patient use applications that is formed of a vapor, air, and liquid permeable material that is disposable and/or inexpensive and/or manufactured and/or assembled in a low-cost manner and is intended to be used for a single patient over a brief period of time, such as an hour(s), a day, or multiple days. As used herein, a multi-use cover sheet is a cover sheet for multi-patient use that is generally formed of a vapor permeable, liquid impermeable and air permeable or air impermeable material that is re-usable, washable, can be disinfected using a variety of techniques (e.g., autoclaved, bleach, etc.) and generally of a higher quality and superior in workmanship than the one-time use cover sheet and is intended to be used by one or more patients over a period of time such as multiple days, weeks, months, and/or years. In various exemplary embodiments, manufacturing and/or assembly of a multi-use cover sheet can involve methods that are more complex and more expensive than one-time use coversheets. Examples of materials used to form one-time use cover sheets can include, but are not limited to, non-woven papers. Examples of materials used to form re-usable cover sheets can include, but are not limited to, Gore-Tex®, and urethane laminated to fabric.

The invention claimed is:

1. A method for using a cover sheet, wherein the cover sheet comprises:

an air mover;

a first layer comprising a vapor permeable material;

a second layer comprising a material oriented and configured to wick fluid toward a perimeter of the cover sheet and being less hydrophobic than the first layer; and a third layer comprising a spacer material and being less hydrophobic than the first layer, wherein the second layer is between the first layer and the third layer, wherein the method comprises:

creating air flow through the spacer material so moisture vapor passing through the first layer and into the second layer is distributed toward a perimeter of the cover sheet, wherein moisture vapor passing into the third layer is removed from the cover sheet by the air flow; and maintaining a relative humidity gradient between air adjacent a person disposed on the cover sheet and air pockets of the spacer material via the air flow.

2. A cover sheet comprising:

an air mover;

a first layer comprising a liquid and vapor permeable material;

a second layer comprising a material oriented and configured to wick fluid toward a perimeter of the cover sheet;

a third layer comprising a spacer material; and a breathable absorption layer located between the second layer and the third layer, wherein the second layer is between the first layer and the third layer and the air mover is configured to create air flow through the spacer material so liquid and moisture vapor passing through the first layer and into the second layer is distributed toward the perimeter of the cover sheet before the liquid and moisture vapor passes into the third layer where the liquid is evaporated.

3. A cover sheet comprising:

an air mover;

a first layer comprising a vapor permeable material;

a second layer comprising a material oriented and configured to wick fluid toward a perimeter of the cover sheet and being less hydrophobic than the first layer; and a third layer comprising a spacer material and being less hydrophobic than the first layer, wherein:

the second layer is between the first layer and the third layer;

the air mover is configured and operatively associated with the first, second and third layers to draw moisture vapor towards the air mover such that air from an upper surface of the cover sheet passes through the first layer, the second layer and the spacer material towards the air mover.

4. The cover sheet of claim 3 wherein the third layer is more hydrophilic than the second layer.

5. The cover sheet of claim 3 wherein the air mover is configured to push air through the spacer material.

6. The cover sheet of claim 3 wherein the cover sheet comprises a central region and a perimeter region extending around the central region, and wherein the central region is configured to be in contact with a patient in contact with the cover sheet during use.

7. The cover sheet of claim 6, wherein the second layer is configured to wick fluid from the central region to the perimeter region.

8. The cover sheet of claim 3 further comprising a sensor configured to detect fluid.

9. The cover sheet of claim 8 wherein the sensor is configured to detect relative humidity.

10. The cover sheet of claim 8 wherein the sensor is configured to control the operation of the air mover.

11. The cover sheet of claim 3 wherein the third layer comprises an open-celled foam structure.

12. The cover sheet of claim 3 wherein the third layer comprises a sintered polymer.

13. The cover sheet of claim 3, wherein the first layer, second layer and third layer are laminated together.

14. The cover sheet of claim 13 wherein the first layer, second layer and third layer are laminated together with adhesives.

15. The cover sheet of claim 3 wherein the spacer material is configured to permit air to flow through the spacer material while the spacer material supports a person laying on the cover sheet.

16. The cover sheet of claim 3 wherein the spacer material comprises one of the following: open cell foam; natural or synthetic polymer particles, filaments, or strands; cotton fibers; polyester fibers; flexible metals and metal alloys; shape memory metals and metal alloys, and shape memory plastics.

17. A method of removing moisture vapor from a person, the method comprising:

disposing a cover sheet according to claim 3 between a support surface and a person; and operating the air mover to provide an air flow through the spacer material.

18. The method of claim 17 wherein operating the air mover provides an air flow directed toward the air mover.

19. The method of claim 17 wherein operating the air mover provides an air flow directed away from the air mover.

20. The method of claim 17 wherein operating the air mover provides an air flow directed toward the air mover.

21. The method of claim 17 wherein the cover sheet comprises a central region and a perimeter region extending around the central region, and wherein the central region is configured to be in contact with the person.

* * * * *